US010473334B2

(12) United States Patent
Crosen

(10) Patent No.: US 10,473,334 B2
(45) Date of Patent: Nov. 12, 2019

(54) FIRE PIT

(71) Applicant: Paul Crosen, Winchester, VA (US)

(72) Inventor: Paul Crosen, Winchester, VA (US)

( * ) Notice: Subject to any disclaimer, the term of this patent is extended or adjusted under 35 U.S.C. 154(b) by 201 days.

(21) Appl. No.: 15/803,575

(22) Filed: Nov. 3, 2017

(65) Prior Publication Data

US 2019/0137107 A1 May 9, 2019

(51) Int. Cl.

| | |
|---|---|
| ***F24B 1/181*** | (2006.01) |
| ***F24B 1/195*** | (2006.01) |
| ***F24B 1/189*** | (2006.01) |
| ***F24B 3/00*** | (2006.01) |

(52) U.S. Cl.

CPC ..... *F24B 1/181* (2013.01); *F24B 1/189* (2013.01); *F24B 1/195* (2013.01); *F24B 3/00* (2013.01)

(58) Field of Classification Search

CPC .... F24B 1/18; F24B 1/189; F24B 1/19; F24B 1/1902; F24B 13/002

See application file for complete search history.

(56) References Cited

U.S. PATENT DOCUMENTS

| | | | | | |
|---|---|---|---|---|---|
| 4,013,059 | A * | 3/1977 | Andrews | F24B 1/18 | 126/500 |
| 4,060,196 | A * | 11/1977 | Goldsby | F24B 1/1885 | 126/502 |
| 4,223,833 | A * | 9/1980 | Ebbers | F24B 1/1902 | 126/509 |
| 5,673,682 | A | 10/1997 | Hannebaum | | |
| 6,790,033 | B2 | 9/2004 | Grady | | |
| 8,327,834 | B1 * | 12/2012 | Judge | F23J 11/00 | 126/25 R |
| 2009/0165772 | A1 * | 7/2009 | Hunt | A47J 36/2477 | 126/25 R |
| 2012/0060819 | A1 * | 3/2012 | Hunt | A47J 36/2477 | 126/1 R |
| 2014/0238378 | A1 * | 8/2014 | Scott | F24B 1/181 | 126/55 |
| 2015/0285507 | A1 * | 10/2015 | Troyer, Jr. | F24B 1/182 | 126/30 |
| 2017/0254535 | A1 * | 9/2017 | Schunk | F23J 11/08 | |

* cited by examiner

*Primary Examiner* — David J Laux
(74) *Attorney, Agent, or Firm* — Da Vinci's Notebook, LLC

(57) ABSTRACT

The present invention includes a fire pit and a system for using the fire pit that includes distinct structures. The fire pit includes an air inlet that allows in forced air for the coursing thereof through a hollowed housing for release through an air outlet. The fire pit may include a plenum that generates a virtual chimney of forced air that directs smoke upward and away from bystanders.

17 Claims, 11 Drawing Sheets

FIRE PIT

FIELD OF THE INVENTION

The present invention relates to the field of outdoor heating implements and more specifically to the field of fire pits.

BACKGROUND

Fire pits are a popular feature in hardscape design and are often the central focus of outdoor gathering and entertainment spaces. Designs vary from simple metal bowls, to free standing metal or terracotta chimneys, to stone or masonry elements. For most people the focus of fire pits seems to be on the ambiance of the open flame and less on the heating efficiencies and properties. Fire pits are very inefficient space heating resources.

You may recall a time when, on a cold wintry evening, you huddled closely around an outdoor fire pit trying to stay warm. No matter how much you try you just can't seem to comfortably position yourself to gain enough warmth from the fire pit. If you are positioned too low then you feel virtually no warmth. If you are positioned higher then you may feel some warmth on the part of the body exposed to the flames but the rest of your body is still feeling cold. Maybe your raised hands and your face are getting some warmth but your feet and backside are freezing cold. Often, the only way to obtain suitable warmth to be comfortable is to reposition yourself continually around the flames. Simply put, sitting beside a fire pit on a cold evening may not be overly enjoyable, relaxing or warm.

Often a cold evening includes a breeze or blowing wind. Breezes and wind wreak havoc on the ambiance of a fire pit. Typical fire pits are susceptible to blowing and gusting wind. Even a small breeze can blow smoke into the area surrounding the fire pit. That's when musical chairs begins! If the wind blows one direction everyone moves to the other side of the fire pit. Then, the wind might change direction and everyone moves to the other side. Why does it seem that fire pit smoke always follows you no matter on which side you are situated?

Fire pits would be so enjoyable if, somehow, someone could efficiently distribute the heat produced from the fire and, somehow, manage the smoke. How wonderful it would be to sit, in warmth, around the fire pit engaging in the pleasant trance of the dancing flames with no smoke to cloud your eyes and your lungs.

SUMMARY

Fire pits are extremely inefficient sources of heat. Most of the heat simply rises straight upward and offers inefficient distribution of heated ambient air. The present invention offers significant advantages to traditional fire pit designs. It provides a heated housing that captures more of the heat of the fire pit and distributes it to a surrounding area. The distribution of heated air can be customized to suit the specific design requirements of the surrounding area.

The present invention is directed to a fire pit and fire pit system utilizing forced fluid advantageously. The fire pit includes a housing with an upper plenum. The housing is substantially sealed to ensure that fluids forced into the housing remain in the housing and enter/exit via intended points. The housing surrounds a cavity wherein fuel may be placed. The housing includes a fluid inlet that accepts forced gases. In a preferred embodiment of the present invention, the gas enters a fluid channel that shunts gas in one or more directions, towards the plenum and also to the fluid pathway.

The plenum abuts the upper portion of the housing and accepts gas from the fluid channel to project a forced gas stream above an apex of the cavity from a fluid vent positioned thereon. While fuel burns in the cavity and emits smoke upwards, the forced gas stream surrounds the smoke to create a virtual 'air chimney' that contains the smoke within the bounds of the stream for a distance determined by the force from the stream. The fluid outlet may take the form of a continuous peripheral outlet or a series of vent apertures arranged about the periphery.

The housing circumscribes the cavity and includes the fluid pathway. The fluid pathway accepts gas from the air inlet, preferably through the air channel, for movement within the housing. The surface of a fire pit may accept a significant amount of heat as they are usually fabricated of metal. The present invention exploits this phenomenon to wind forced gas within the housing in a helical course to maximize the exposure of gas to the heat from the adjacent burning fuel. The preferred means for achieving this helical path is the use of one or more shelves that leave gaps that allow gas to ascend or descend to the next shelf. The shelves are positioned within an inner wall and outer wall of the housing. When the gas reaches the terminus of its pathway within the housing, it is ejected through a fluid outlet.

According to a system of the present invention, the gas escaping through the fluid outlet may then enter a conduit that conducts the heated gas to a distant environmental fixture. The fixture may include any structure that is meant to be substantially stationary, for example, a peripheral bench, brick structure, or a specialty seat. The structure includes a surface that is capable of venting the heated gas, preferably back in the direction of the fire pit to generate a substantially uniform field of heat between the fire pit and the structure.

A blower may be operatively connected to the fire pit to supply the force to urge gas throughout the fire pit and system. In a preferred version of the present invention, the blower is concealed by the structure.

Imagine an outdoor entertainment space composed of concrete pavers, masonry seating and a fire pit with a decorative stone surround utilizing under-paver, or other subsurface, piping to distribute heat throughout the entire entertainment area. The heat ducts can be extended to heat the seating surface areas or to provide under-seat leg space heat for warmth and comfort while enjoying the ambiance of the open fire pit; or the ducts can exhaust heated air at multiple locations in the paver base to provide warmth and comfort to the paver floor space. Is smoke irritating your eyes? The top surface outflow air vent apertures can provide relief by channeling smoke upward and away from the surrounding space. All of these features combine to create a unique and enjoyable fire pit experience.

These aspects of the invention are not meant to be exclusive. Furthermore, some features may apply to certain versions of the invention, but not others. Other features, aspects, and advantages of the present invention will be readily apparent to those of ordinary skill in the art when read in conjunction with the following description, and accompanying drawings.

DETAILED DESCRIPTION

Figure 1:
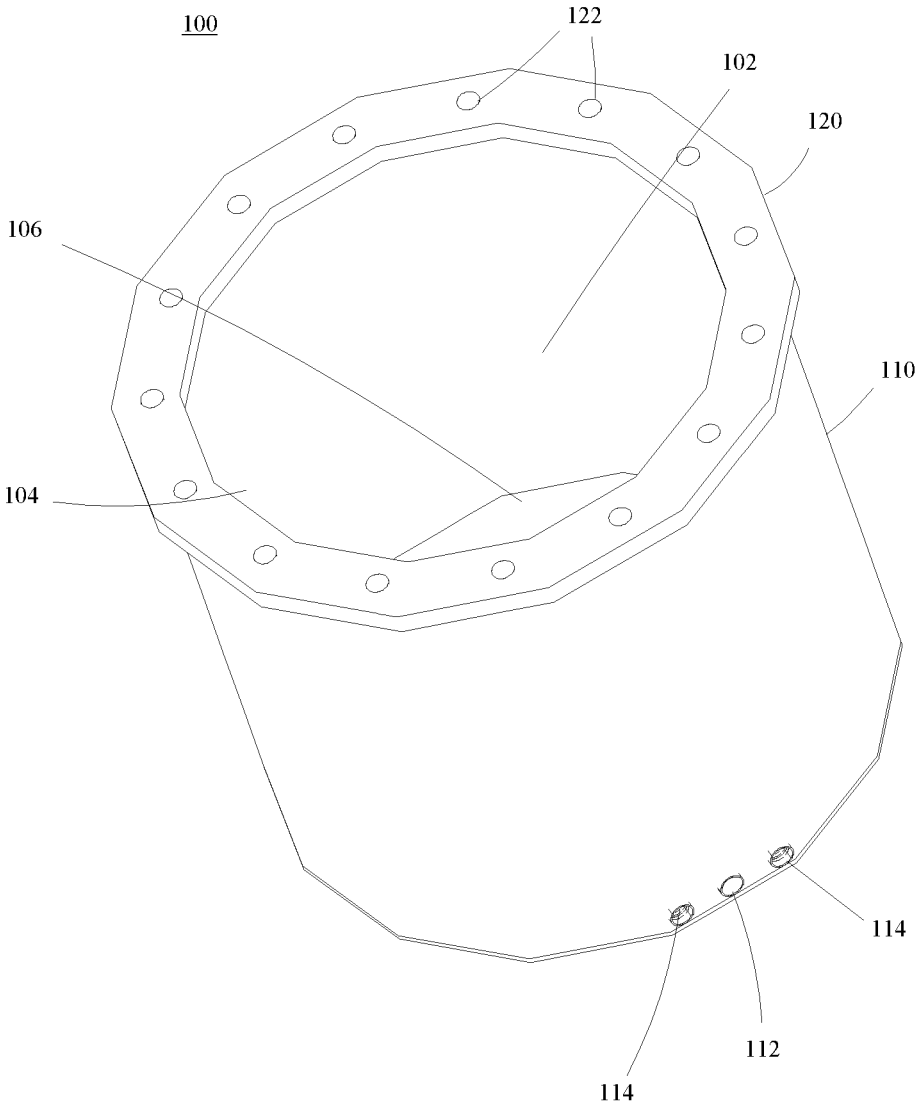
FIG. 1 is a perspective view of the fire pit of the present invention.
Figure 2:
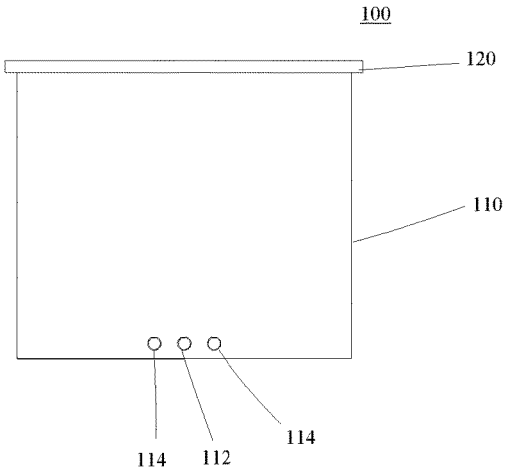
FIG. 2 is a front, plan view of the fire pit of the present invention.
Figure 3:
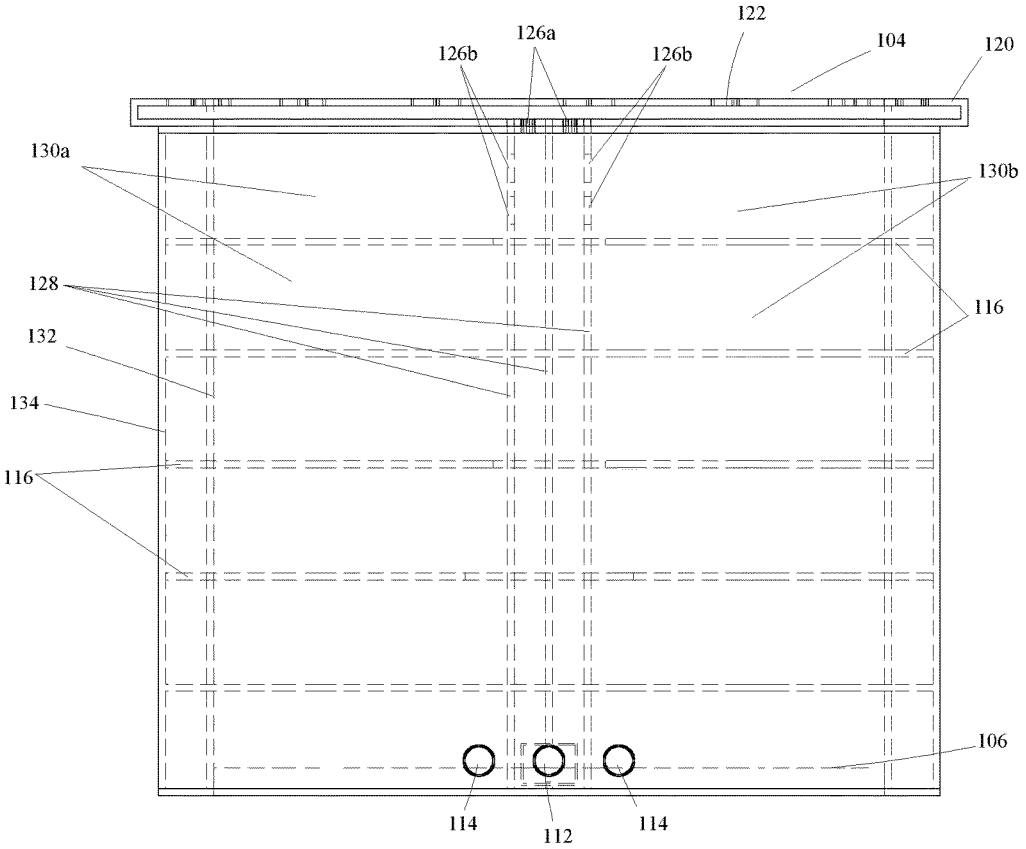
FIG. 3 is a front, revealed view of the fire pit of the present invention.
Figure 4:
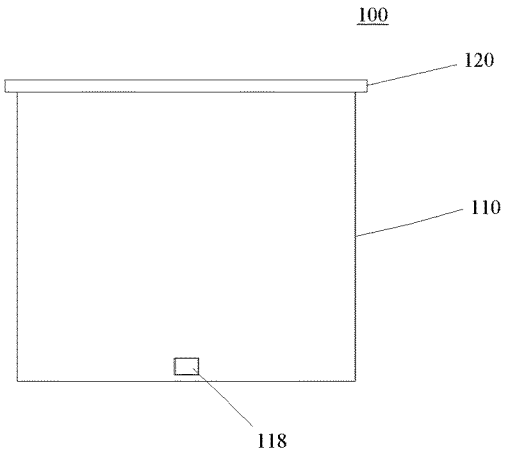
FIG. 4 is a back, plan view of the fire pit of the present invention.
Figure 5:
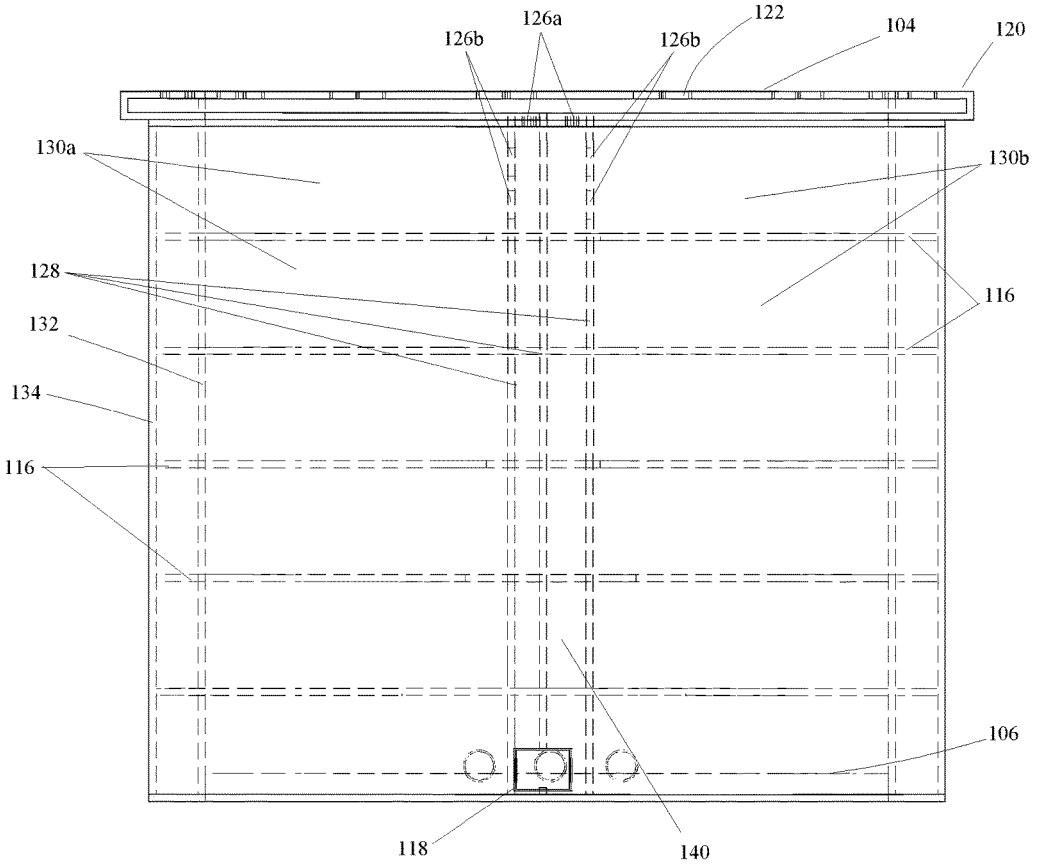
FIG. 5 is a back, revealed view of the fire pit of the present invention.

Referring first to FIG. 1, a basic embodiment of the fire pit 100 is shown. The fire pit 100 features many advantages not present in the current state of the art. The fire pit 100 includes a housing 110 and a plenum 120, the housing 110 acts to circulate forced air within itself while accepting heat from a centralized fuel cavity 102. The plenum 120 accepts forced air, which it then directs upward to create an air curtain surrounding the fuel bay to provide a physical barrier to prevent the outward passage of smoke from the burning fuel. The present invention may feature one or both of these aspects, and the present disclosure will focus on preferred embodiments that utilize both, as well as other, aspects.

The embodiment of the fire pit 100 of FIGS. 1-7 includes a housing 110 that features a preferred configuration under the present invention. The housing 110 supports a forced fluid intake 112 on the outer wall 134 thereof. The use of "fluid" in the present disclosure is meant to encompass any gas that can be utilized with a fire pit. The most natural fluid is simply that of natural air, i.e., mixtures of nitrogen, oxygen, argon, carbon dioxide, water vapor, etc. However, any gas capable of being used with the present invention may be used. Air enters the fluid intake 112 and enters the fluid channel 140. The preferred fluid channel 140 is a course formed between a housing inner wall 132, the housing outer wall 134, and inner partitions 128 that seals the majority of the fluid channel 140 from the remainder of the housing 110. The fluid channel 140 directs air upward within the housing until the air encounters passages 126 for transition to other portions of the fire pit 110. Naturally, the use of directional phrases, such as "upward" and "downward" are meant to be applicable to the embodiments discussed. Directions in other embodiments will be related to that particular embodiment in whatever manner fulfills the objectives of the present invention. Here, for example, the present invention directs air upwards because doing so creates a path that exposes air to the heat of the combustion within the fire pit. This is particularly true with the shelving. Passages 126 may include plenum passages **126*a* and pathway passages 126*b***.

Air that is routed through the pathway passages **126*b* enters the fluid pathway 130 of the present invention. The fluid pathway 130 is avenue through which fluid from the fluid channel 140 is circulated throughout the housing 110 to accept heat emanating from the fuel cavity 102. The preferred embodiment of the present invention includes two sets of pathway passages 126*b* that allow entry of air into a bifurcated fluid pathway 130*a*, 130*a*. Other embodiments may utilize merely a single passage, or three or more passages. The pathway 130 may be bounded by the inner wall 132 and outer wall 134 as well as housing partitions 128. Passages 126 are bored into the partitions 128 of the fluid channel 140, or the partitions may simply lack material around areas where the pathway 130 begins. In the preferred embodiment the fluid channel 140 guides incoming air to pathway passages 126*b* adjacent to plenum passages 126*a* to prevent either set of passages 126** from consuming a disproportional amount of air with respect to the other. Although the present embodiment discusses the fluid pathway in terms of shelving integrated with the sidewalls of the fire pit, any construction that fulfills the objectives of the present invention may be utilized. Other pathways may be constructed using conduit or other piping that obviates the need to weld or braze metal within the fire pit. The conduit may be applied to the interior of the fire pit in a helical manner that ensures substantial contact with heat from the combustion chamber.

Figure 6:
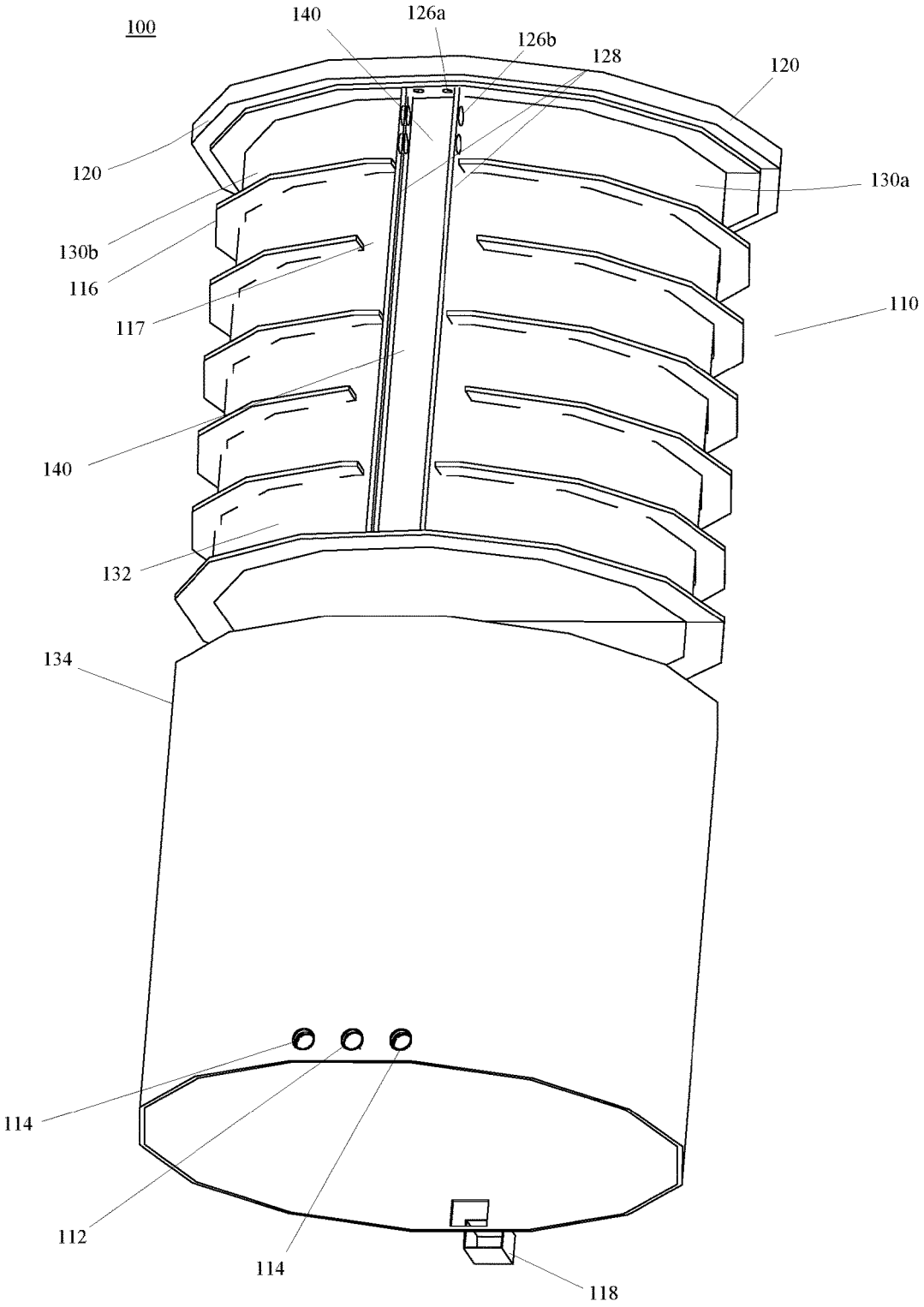
FIG. 6 is a perspective, exploded view of the fire pit of the present invention.
Figure 7:
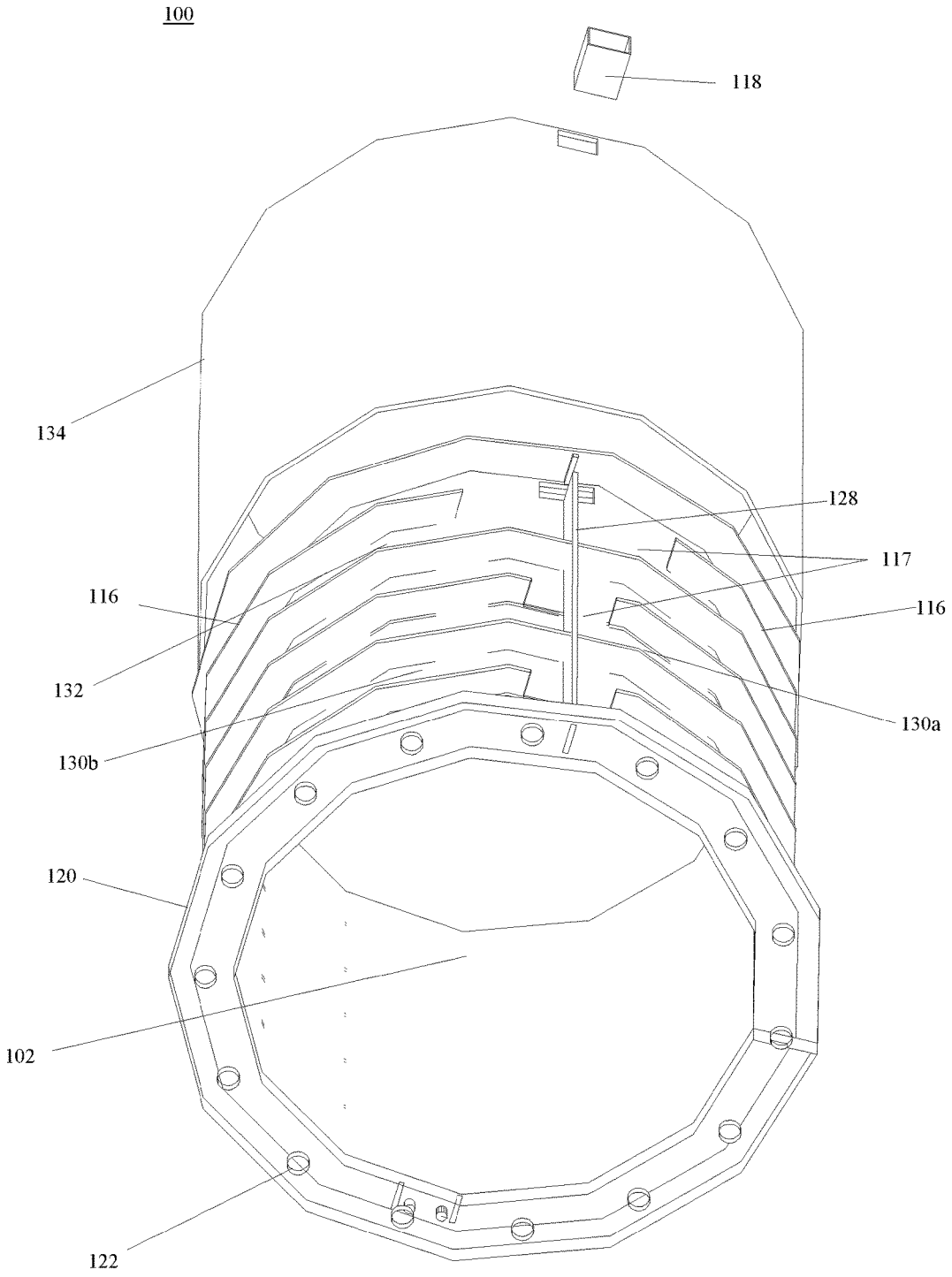
FIG. 7 is a perspective, exploded view of the fire pit of the present invention.
Figure 8:
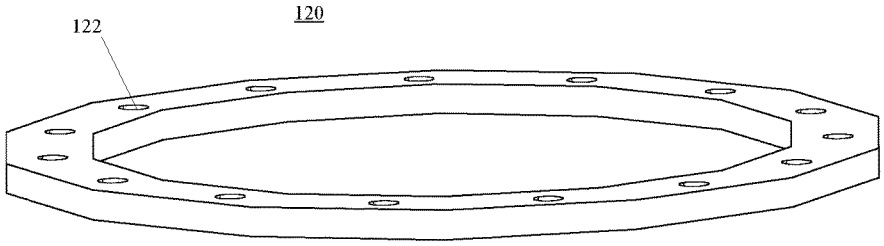
FIG. 8 is a top, plan view of the plenum of the present invention.
Figure 9:
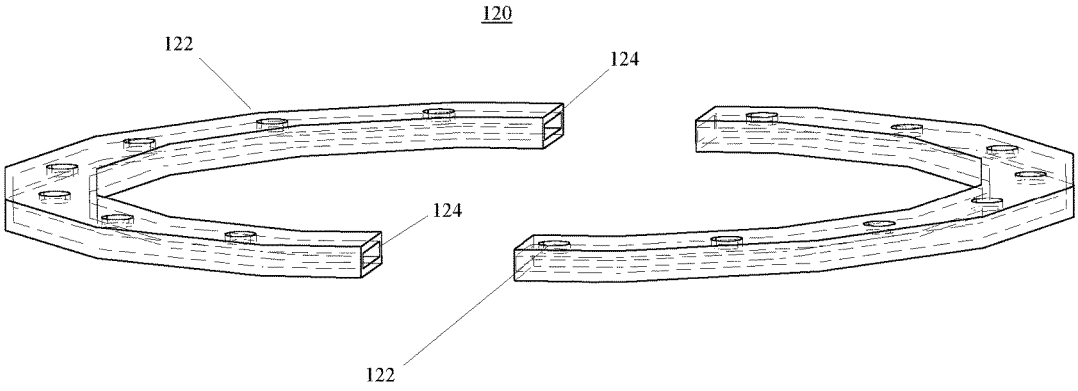
FIG. 9 is a perspective, bisected view of the plenum of the present invention.
Figure 10:
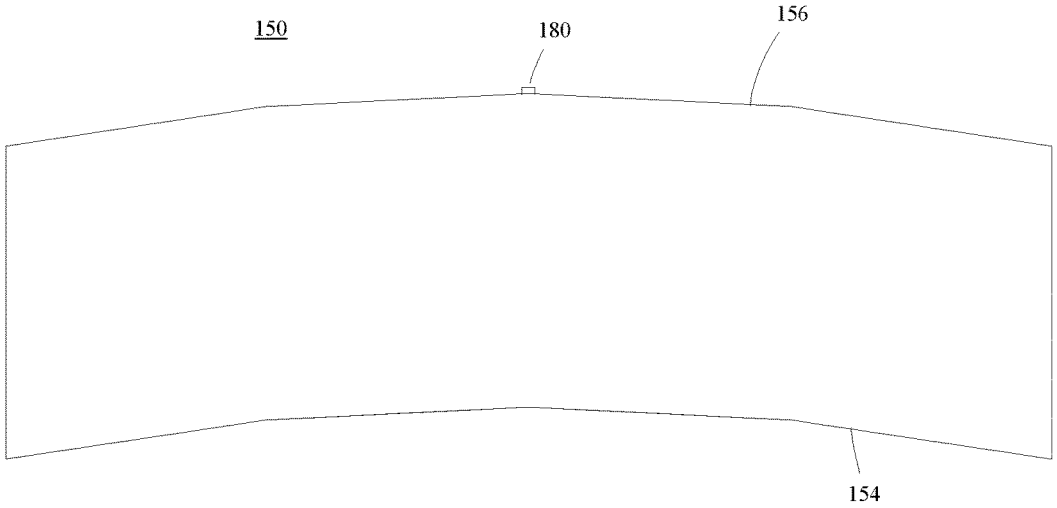
FIG. 10 is a top, plan view of the fire pit of the present invention.
Figure 11:
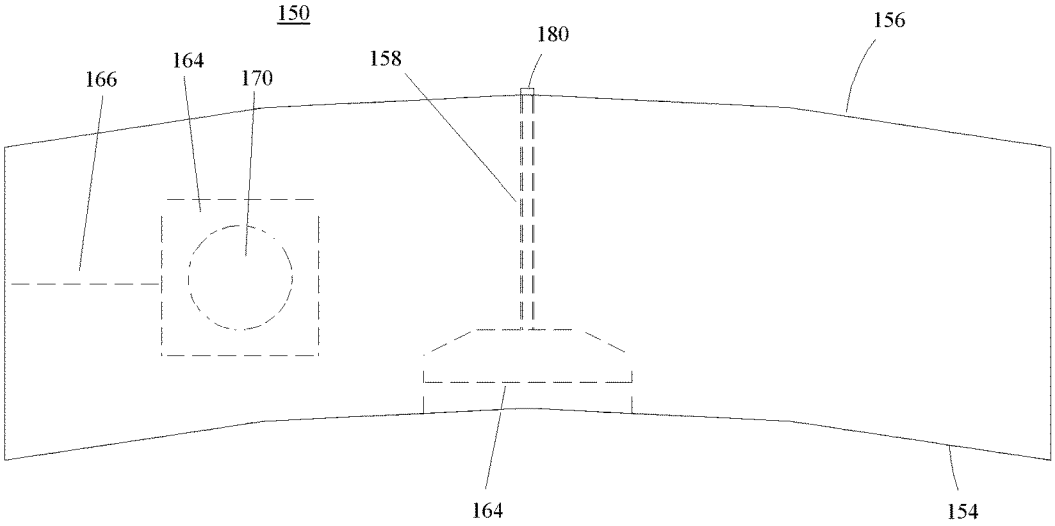
FIG. 11 is a top, revealed view of the fire pit of the present invention.
Figure 12:
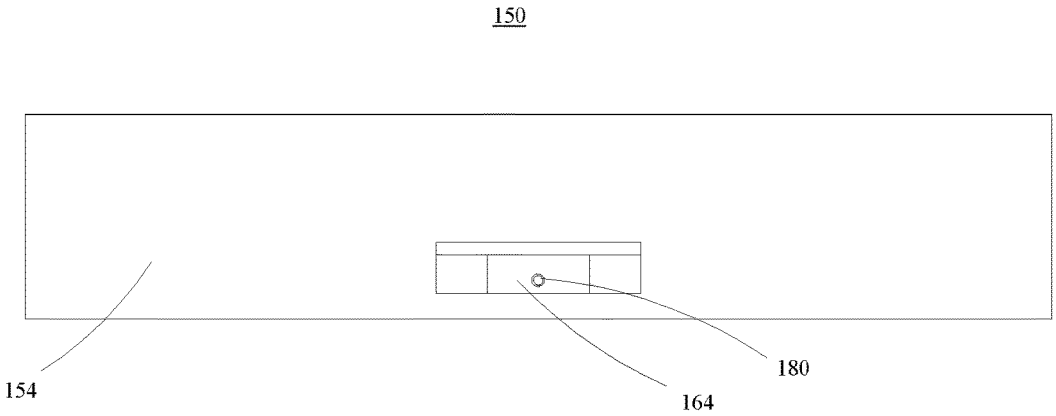
FIG. 12 is a front, plan view of the fire pit of the present invention.
Figure 13:
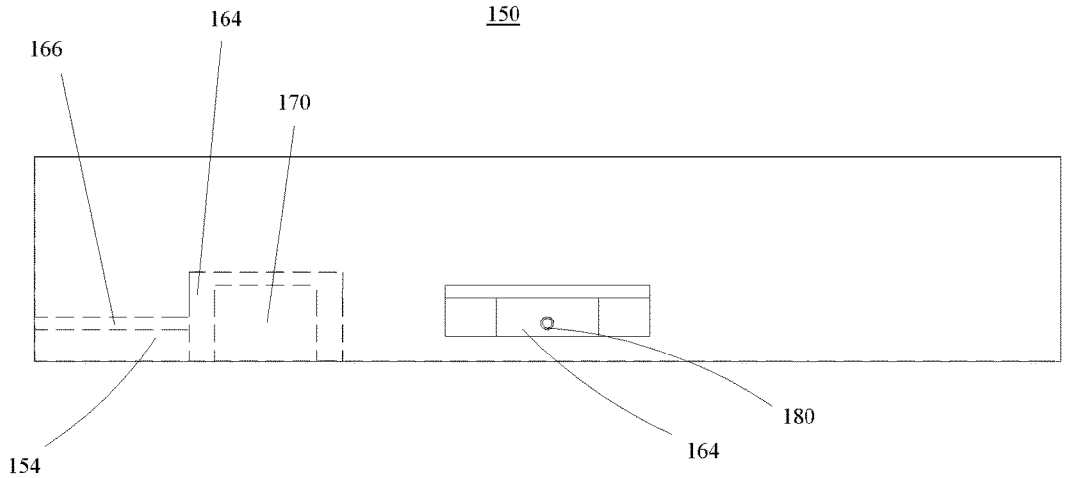
FIG. 13 is a front, revealed view of the fire pit of the present invention.
Figure 14:
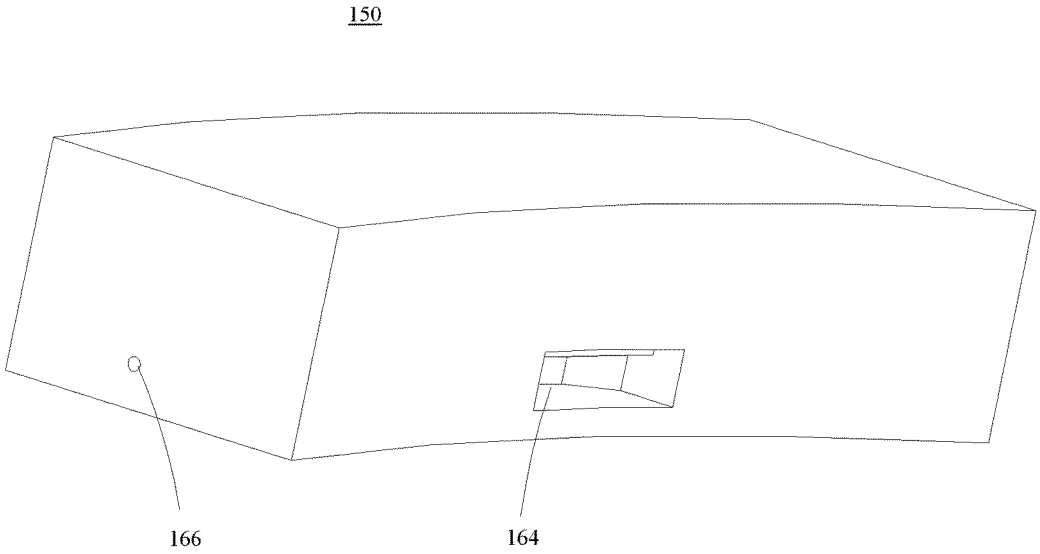
FIG. 14 is a front, perspective view of the fire pit of the present invention.
Figure 15:
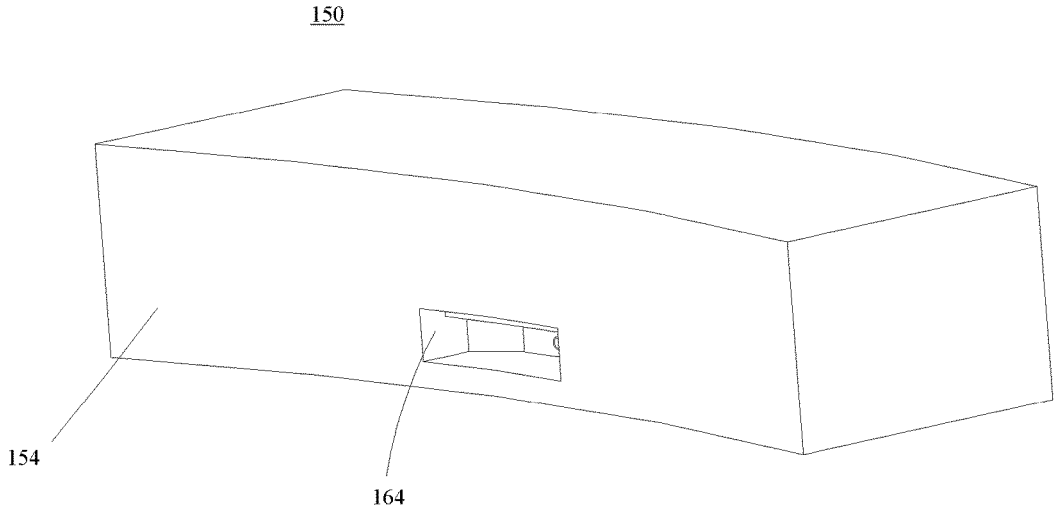
FIG. 15 is a front, perspective view of the fire pit of the present invention.
Figure 16:
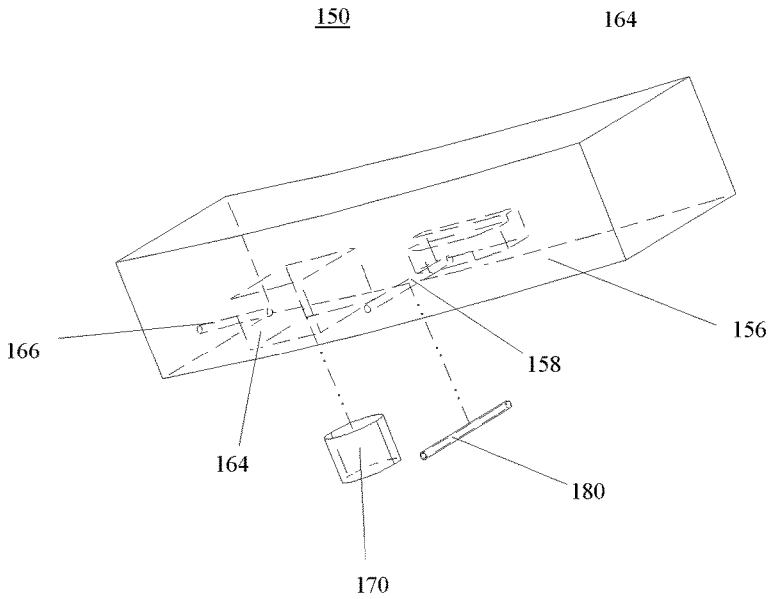
FIG. 16 is a back, exploded view of the fire pit of the present invention.

Air that has passed through the pathway passages **126*b* may be bounded initially by the inner wall 132, outer wall 134, and shelving 116 placed within the housing to create a helical course within the housing to maximize the exposure of air within the pathway 130 to heat from the fuel cavity 102. Air within the housing 110 will eventually be released via a fluid outlet 114 and the present invention seeks to maximize the pathway distance between the fluid inlet 112 and the fluid outlet 114 to correspondingly maximize heat exposure. The preferred embodiment of the present invention utilizes multiple shelves 116 to create a helical pathway within the housing. As best shown by FIGS. 6-7, the shelves 116 are positioned sealingly between the inner wall 132 and outer wall 134 but in a manner that results in shelf gaps 117 between the front partition 128 (adjacent to fluid channel 140) and back partition 128 (adjacent to fuel port 118). Reviewing the housing 110 from an apex 104 of the housing 110 to the base 106 of the housing 110, the shelf gaps 117 for the five shelves 116 are positioned on back:front:back; front:back, which when lead to the lowest pathway segment, at the end of which (i.e., the terminus) the fluid outlet 114 is positioned. Thus, air winds about approximately half of the perimeter of the housing before it is stepped-down to a lower level of shelving 116 via a shelf gap 117 between the shelf 116 and the partition 128. In embodiments of the invention utilizing a single passage, partitions may not be necessary. Then, it has transitioned to a new, discrete level and begins its course in a contrary direction to a front shelf gap 117. Thus, the air continues this circuitous and helical course until it reaches the fluid outlet 114 and is available for expulsion. A preferred embodiment includes two or more fluid outlets 114 that are in fluid communication with the two distinct pathways 130*a*, 130*b* as bifurcated by the internal partitions 128. The present invention need not include the bifurcating, and may include a single, helical pathway, or even more than two pathways. The primary concerns are that the air is passed through the housing 110 for a distance that permits the temperature of the air to be effectively raised by the combustion occurring the fuel cavity 102**. Commercial embodiments of the present invention may include multiple fluid inlets and multiple fluid outlets. The quantity of apertures used in the present invention will strongly relate to the use of the fire pit and the quantity of environmental structures that may be used therewith. For example, a restaurant with an open deck utilizing the present invention may have conduit connecting to each customer table on the deck, which may include three to fifteen (or other) tables. As the number of heated fluid destinations increases, there may be a need to increase the number of inlets to three to five (or other).

A fire pit 100 achieves its purpose because it provides heat and visible aesthetics to an outdoor (usually) gathering. A fire pit includes a place to hold solid fuel for combustion. The present invention includes a fuel cavity 102 for the placement of wood, coal, or other form of appropriate fuel for combustion. The present invention may often utilize a higher profile than the common fire pit to achieve the objectives of the present invention. The fuel cavity includes an apex 104 and a base 106. The apex 104 and base 106 are primarily conceptual and correspond to the lowest point and highest point, respectively, of the fire pit. The base 106 may also include as a physical component a floor, as is depicted in FIGS. 1-7, that is affixed to the housing 110. Embodiments of the present invention may, or may not, include an affixed floor as appropriate. As the distance between the apex to the base is considered to be the height of the fire pit, it is worth noting that, depending on the number of shelves, the distance that air travels in the pathway, i.e. pathway distance, may be many times greater than the height of the fire pit housing. It is preferred that the distance be at least a ratio of 2:1 without an upper limit. Each shelf, assuming that for purposes of multiple pathways, the shelving is approximately equivalent in each pathway, adds approximately $\pi(d)$ to the path length of the pathway. Each shelf added for distinct pathways would add approximately (because gaps affect the total result) $\pi(d)$/(No. of pathways).

As earlier noted, the benefits of a fire pit are both aesthetic and functional. However, the energy radiated from a fire pit is Gaussian in nature. There is a significant amount of heat in the center that diminishes rapidly as the heat radiates from the source. The present invention overcomes this disadvantage by utilizing environmental structures to ameliorate the inherent non-uniformity of getting heat from a centralized fire. Turning now, to FIGS. 10-17, in addition to FIGS. 1-7, the present invention includes a system 200 that combines environmental structures 150 with the fire pit 100 to control the direction and magnitude of heat in an area. As heated air leaves the fire pit 100 through the fluid outlet 114, it may be directed by conduit 180 to the environmental structures 150 placed distant from the fire pit 100. The conduit of the present invention may include any structure adapted to transport a fluid from one position to another in a substantially sealed manner. In practice, fire pits 100 tend to be affixed in the center of a gathering place with environmental structures placed peripherally for enjoyment of the fire pit. By environmental structures 150, it is meant relatively immobile structures that are often used in the environment of a fire. These relatively immobile structures may include solid benches, masonry and faux-masonry (which may or may not support seating), solid seating, walls, etc.

Embodiments of the present invention may utilize stationary or substantially stationary environmental structures. By stationary, it is meant such structures as created with the intention of permanent affixation to land or property affixed to the land. Examples of stationary structures includes walls, landscape structures, etc. The present invention may utilize substantially stationary structures, that is to say, structures that are positioned indefinitely such as movable outdoor seating. An invention that is ideally moved without a tool is substantially stationary.

The conduit 180 leads to the structure 150 that may include interior voids 164 for the shunting and release of the heated air that originated from the fire pit. The preferred structure includes an arcuate body that demarcates a heated zone between the structure 150 and the fire pit 100. If placed well, the structure 150 and the fire pit 100 can supply a zone of relatively uniform heat between the two structures that obviates the need to seek an appropriately heated area. Furthermore, the heat from the structure will lack the smoke emitted from a fire pit. This air does not derive directly from the central fuel cavity, but instead only indirectly receives heat therefrom through conductive surfaces of the housing. Preferred materials for construction of housing include materials that have high thermal conductivity coefficients. This is particularly true of the inner wall, which may be constructed of a material that differs from the outer wall, which may even preferably be constructed of a material with low thermal conductivity for purposes of safety and efficiency. Rather than utilize different materials for the outer wall, the outer surface of the housing may instead be coated with a material of low thermal conductivity. A preferred construction material includes steel.

Figure 17:
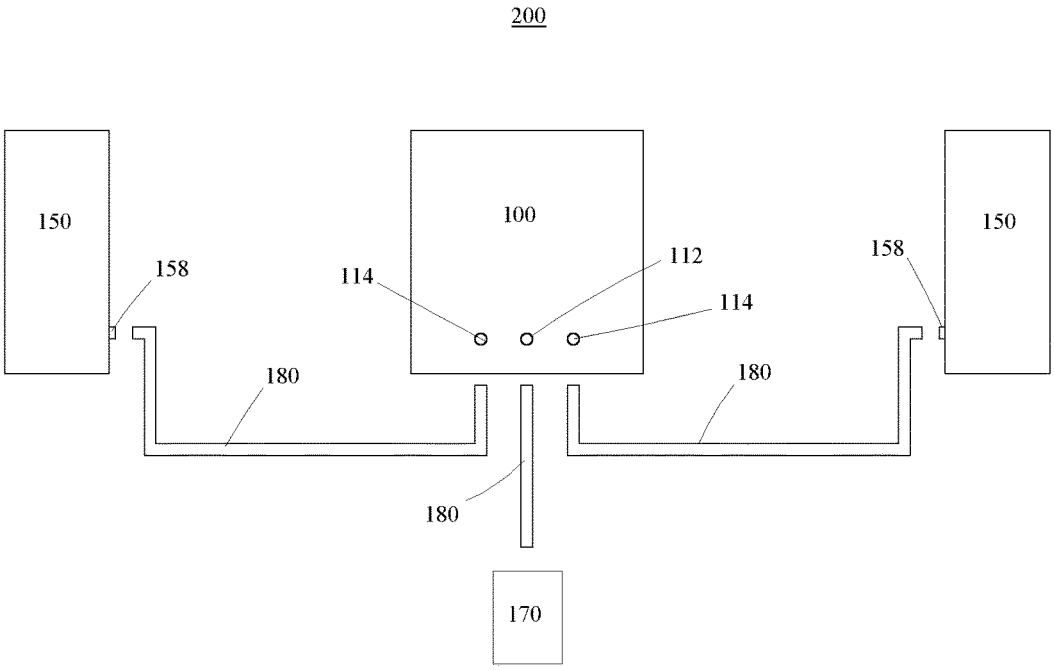
FIG. 17 is a view of the system of the present invention.

Conduit 180 may conduct air from the fire pit 100, which then connects with the fluid intake 158 of the structure 150. The air is then conducted to the void 164 on surface 154,156 of the structure. Because the preferred structure includes an arcuate orientation, the surfaces may be conceptually divided into a minor surface 154 (the surface pointing inward if a circle were created from the structure) and a major surface 156 (the surface pointing outward if a circle were created from the structure). The shape of the structure may be any useful for the purposes of the present invention. Because the structure may take the form of chairs or benches, the shapes could be highly creative and irregular. It is, however, a prime objective of the present invention to create a uniformly heated gathering zone; and therefore, as shown by FIG. 17, it is preferred that the structures 150 form a periphery of multiple structures uniformly spaced from a center point to achieve a uniform zone of heat. A primary structure would include the first structure to be placed distant from the fire pit, whereas each additional structure would be a supplemental structure. As shown in FIG. 17, the two structures 150 (primary and supplemental) are located roughly equidistant from the fire pit 100. Both are connected by conduit 180 and are provided forced air from the same blower 170. Note that the number of outlets 114 of the fire pit 100 may be increased to correspond to the number of structure intended to be used with the fire pit; alternatively, a junction hose may be used to turn a one-passage conduit into a multiple-path conduit.

The blower 170 of the present invention is a component that urges forced fluids throughout the entities of the present invention. Any device that moves air at a pace greater than the existing, ambient air pace may be utilized, e.g. an air compressor or fan. The blower 170 may be located in the fire pit 100, in the structure 150, or other location whereby the blower is in fluid communication with the air inlet 112 of the fire pit. Because the fire pit reaches extreme temperatures, it is preferred that the blower 170 be located distant from the fire pit 100. A preferred location for the blower 170, as shown by FIGS. 12-16, is within a void 164 of the structure 150 that can mask the presence of the blower 170, yet still make the blower 170 available for periods of replacement, repair, or repowering. Internal conduit 166 within the structure 150 provides a means for air to exit the structure 150 from the blower 170 and be channeled to the fire pit for return back to the structure.

Figure 18:
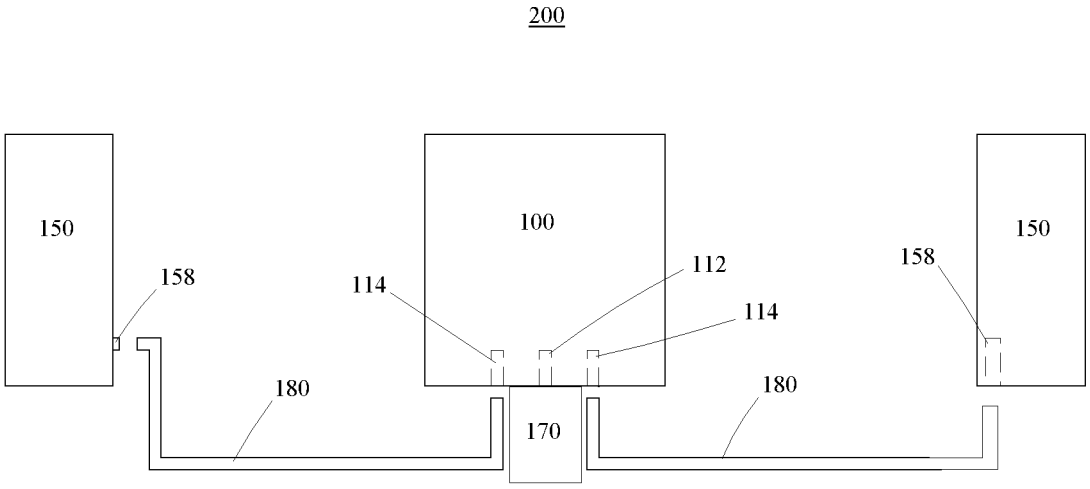
FIG. 18 is a view of the system of the present invention.

Turning now to FIG. 18, the present invention may include alterations of the components that do not substantially affect the performance of the system 100. Examples of this include inlet 112 and outlet 114 locations that are capable of being concealed. In a preferred commercial embodiment, the fire pit 100 includes an externally uniform appearance that shelters apertures from the view of casual observers. Pursuant to this strategy, the base 106 is elevated above the housing 110 to permit the fluid inlet 112 and the fluid outlet(s) 114 to be inaccessible from an exterior point. Similarly, any environmental structures 150 used with the fire pit may utilize concealed apertures positioned in an underside or concealed by eternal structures. Much of the heated air will be distributed to the surrounding area via conduit 180 that exit from underneath the fire pit and extend under the patio/ground surface to the desired location. The blower 170 may be affixed to the housing 110 or located externally. In certain preferred embodiments the base will not be elevated. Instead, the outlet will be extended below the base. The base is designed with female threaded ports that are sealed with a male threaded flat plug. If the install calls for sub-surface outflow, then the plug(s) will be removed and an extension (male threaded pipe) will extend into the ground several inches. Then, typically, an elbow will be attached to turn the outflow air toward the intended direction of flow. Tubes/pipes are attached to the elbow and proceed under surface to the external distribution location.

Turning now to FIGS. 1-9, the present invention may utilize an environmental structure to minimize smoky, heated air, as well as a specialized plenum 120. The preferred plenum 120 of the present invention is affixed atop the housing 110 of the fire pit 100. Internal plenum passages 126*a* lead from the fluid channel 140 into the void 124 of the plenum 120. The plenum 120 is a structure that both surrounds the fuel cavity 102 and provides access to the apex 104 of the cavity. The plenum 120 includes a vent that is preferably composed of multiple vent apertures 122. The vent apertures 122 are holes in the plenum that surround the apex 106 of the cavity 102 to generate a virtual chimney about the fire pit. The virtual chimney is created by the curtain of jetted air from the vent apertures 122 that provide a stream of annular air that encapsulates the smoke from cavity 102. The air curtain creates a physical barrier to the longitudinal migration of smoke from the fire pit 100 that only negligibly affects that radiation of heat from the fire pit. The preferred shape of the plenum is that of an annular ring that positions uniformly-spaced vent apertures upwardly. The shape of the plenum, and the dimensions and orientations of its apertures, may be any that can achieve the purposes of the present invention. The vent, rather than being composed of multiple apertures, may for example, be formed of a single peripheral aperture composed of embedded ring structures. The vent apertures may be simple recesses in the top of the plenum, or may include angled recesses of specialized dimensions (e.g., elliptical) that not only jet upwardly, but in a cyclone fashion.

The environmental structures of the present invention may be many and diverse. In a preferred commercial embodiment of the present invention, there may be multiple registers in fluid communication with one or more fire pits. The use of outdoor heaters in the winter can be more than a comfort factor for a business, particularly restaurants; outdoor heating can be draw. In such situations, particularly outdoor decking, the present invention may include one or more fire pits connected to one or more environmental structures for the heating of a seating area. The registers may be positioned proximate or affixed to seating structures or tables and placed about the fire pit. The register may be a circular register that urges heated air in all directions. The registers may be placed on or about tables, or the environmental structure may be its own entity that serves no purpose but the distribution of heat—and perhaps décor.

The present invention may include such other components and devices for the otherwise efficient activity of a fire pit. For example, the air channel 140 may direct air into the combustion cavity 102 for the more efficient combustion of fuel. As the combustion achieved by a fire pit does not require the use of pressurized air, a lower combustion port 118 may be utilized to supply gas to the combustion chamber. When ambient, atmospheric gas is allowed into the combustion chamber from below, while the combusted gas rises upward, there is not interference between the incoming and outgoing gas to interfere with the combustion. The preferred combustion port 118 is sealed from both the fluid channel 140 and the pathway 130.

The fire pit of the present invention provides the opportunity to improve the ambiance and enjoyment of outdoor entertainment. Its ability to utilize customized air distribution features offers outstanding design flexibilities for outdoor entertainment that traditional fire pits do not offer. Imagine a brisk evening sitting on a decorative, masonry wall seating area with heated air distribution features encircling a centrally installed fire pit of the present invention in an outdoor entertainment area. Conduits distribute heated air to seating and other landscape surfaces, leg and feet areas and to floor spaces surrounding the fire pit making the ambiance of the open flame a more comfortable experience.

Fire pits offer enjoyable opportunities to relax, socialize, and entertain. However, where there is fire, there is smoke. Smoke creates discomfort and annoyance. The smoke mitigation features of the present invention helps to direct the smoke upwards and away from the entertainment space. The present invention distinguishes itself from the bulk of commercial, outdoor fire pits. With the present invention guests will enjoy the ambiance of the flames and crackle of an outdoor fire within the comfort of a customized, heated entertainment space.

Although the present invention has been described in considerable detail with reference to certain preferred versions thereof, other versions would be readily apparent to those of ordinary skill in the art. Therefore, the spirit and scope of the appended claims should not be limited to the description of the preferred versions contained herein.

What is claimed is:

1. A fire pit comprising:

a housing surrounding an exposed central fuel cavity having a base and an apex and supporting a (i) radial, fluid channel, defined by an inner wall, circumscribing said cavity and an outer wall circumscribing said inner wall, in fluid communication with a fluid inlet, (ii) at least one radial shelf defining a helical fluid pathway within said housing, distinct from said fluid channel, and (iii) a fluid outlet in fluid communication with said pathway; and an annular plenum, in fluid communication with said radial fluid channel, defining an upper peripheral vent adapted to project a pressurized annular stream of fluid surrounding said apex of said cavity.

2. The fire pit of claim 1 wherein said housing includes at least three radial shelves defining said helical fluid pathway within said housing.

3. The fire pit of claim 2 wherein said housing includes a bifurcated pathway terminating in a fluid outlet comprising a first outlet and second outlet at distinct termini.

4. The fire pit of claim 1 wherein said upper peripheral vent includes an array of vent apertures annularly arranged about said plenum.

5. The fire pit of claim 1 further comprising a blower in fluid communication with said fluid inlet.

6. A fire pit system comprising:

a fire pit comprising:

a substantially sealed housing surrounding an exposed central fuel cavity having a base and an apex; an inner wall, circumscribing said cavity; and an outer wall circumscribing said inner wall; at least one radial shelf between said inner wall and said outer wall defining a helical fluid pathway in fluid communication with a fluid inlet and a fluid outlet;

a blower in fluid communication with said fluid inlet;

conduit in fluid communication with said fluid outlet; and a primary environmental fixture, positioned distant from said fire pit, having a body with a fixture surface thereon; an intake, in fluid communication with said conduit; a void in fluid communication with said intake; and a register, positioned on said fixture surface toward said fire pit.

7. The system of claim 6 wherein said environmental fixture includes an arcuate body with a minor surface bearing said register and a major surface opposite said minor surface.

8. The system of claim 6 wherein said housing includes at least three radial shelves defining said helical fluid pathway within said housing.

9. The system of claim 8 wherein said housing includes a bifurcated pathway terminating in a fluid outlet comprising a first outlet and second outlet at distinct termini.

10. The system of claim 6 further comprising a supplemental environmental fixture, positioned distant from said fire pit and said environmental fixture, having a body with a fixture surface thereon; an intake, in fluid communication with a supplemental conduit; a void in fluid communication with said intake; and a register, positioned on said surface directable toward said fire pit.

11. The system of claim 10 wherein said supplemental environmental fixture is positioned opposite said primary environmental fixture.

12. The system of claim 6 wherein said blower is positioned within said primary environmental fixture.

13. The system of claim 6 wherein said register is directable toward said fire pit.

14. A fire pit comprising:

a substantially sealed housing surrounding an exposed central fuel cavity having a base and an apex; an inner wall, circumscribing said cavity; and an outer wall circumscribing said inner wall; at least one radial shelf between said inner wall and said outer wall defining a helical fluid pathway, having a pathway distance greater than a height distance between said base and apex, in fluid communication with a fluid inlet and a fluid outlet; and a fluid channel in fluid communication with said fluid inlet;

an annular plenum, in fluid communication with said radial fluid channel, defining an upper peripheral vent adapted to project a pressurized annular stream of fluid surrounding said apex of said cavity; and a blower in fluid communication with said fluid inlet.

15. The fire pit of claim 12 wherein a ratio of said pathway distance to said circumference distance is greater than 1.5:1.

16. The fire pit of claim 12 wherein a ratio of said pathway distance to said circumference distance is greater than 2:1.

17. The fire pit of claim 12 wherein said housing includes a bifurcated pathway terminating in a fluid outlet comprising a first outlet and second outlet at distinct termini.

* * * * *